United States Patent [19]

Brotz

[11] Patent Number: 4,627,895

[45] Date of Patent: Dec. 9, 1986

[54] MANUFACTURING PROCESS FOR A PLATED CARBONIZED RESIN-COATED PAPER STRUCTURE

[76] Inventor: Gregory R. Brotz, P.O. Box 1322, Sheboygan, Wis. 53081

[21] Appl. No.: 842,300

[22] Filed: Mar. 21, 1986

Related U.S. Application Data

[63] Continuation-in-part of Ser. No. 738,401, Apr. 1, 1986.

[51] Int. Cl.[4] ..... C25D 5/54

[52] U.S. Cl. ..... 204/20

[58] Field of Search ..... 204/9, 11, 20

[56] References Cited

U.S. PATENT DOCUMENTS 4,579,632 4/1986 Brotz ..... 204/9

*Primary Examiner*—T. M. Tufariello

*Attorney, Agent, or Firm*—William Nitkin

[57] ABSTRACT

A process for forming a metallic structure out of a paper shape by coating the shape with a liquid carbonizable resin, curing the resin, baking the resin-coated shape until the resin carbonizes, and metallic plating the structure.

4 Claims, 5 Drawing Figures

MANUFACTURING PROCESS FOR A PLATED CARBONIZED RESIN-COATED PAPER STRUCTURE

This application is a continuation-in-part of my previous application entitled Electro-formed Structures, Ser. No. 738,401 filed 04/01/86, now pending.

BACKGROUND OF THE INVENTION

1. Field of the Invention

The process of this invention resides in the field of the production of solid structures and more particularly relates to a process for making solid structures out of structures initially made of paper or equivalent material.

2. Description of the Prior Art

It is well known in the prior art to create thin planar structures by molding processes and the like. It is also well known to produce structures made of paper such as folded paper airplanes or shapes made of paper such as by the art of origami or other paper structures, paper being generally described as well known cellulose material having a thin planar structure which is generally foldable and which in some cases may be stiff such as a cardboard or thin such as writing paper.

SUMMARY OF THE INVENTION

The process of this invention is to create permanent, hard, metallic structures out of paper products. In many instances it is difficult and costly in the prior art to create a mold of a product having thin planar members. It is an object of the process of this invention to produce such structures by very economical means.

Basically the process includes treating folded or formed paper and, for purposes of illustration only a paper airplane in the well-known embodiment when it is made into a glider is used herein although any other structure of paper, whether folded or unfolded, whether attached at various points by glue or not is suitable for use in the process of this invention. However, if glue is used to hold the structure together, such glue must conform to certain requirements such as having the ability to hold the paper structure together during the process of this invention.

After having created the structure desired out of paper to be made into a metallic solid, one first coats the paper with a solution of a carbonizable resin in a solvent. This solution can be sprayed onto the paper structure so as to thoroughly saturate the paper, or the paper object can be dipped in a tank of such solution as long as the solution reaches all parts of the paper and saturates the paper. The structure then can be held in a jig until the solvent has been driven off and the resin has cured. The structure now is inflexible. The next step in the process is to bake the structure to carbonize the resin. The resin that had permeated the paper is turned to carbon so that the structure has now quickly and easily been replaced by a carbon copy. During carbonization, the paper fiber is converted to a char within the glassy carbon residue. This carbon structure is then plated such as in a metallic plating bath where it can be plated with a chrome plating or equivalent. Before plating the structure, it is helpful to cut off sharp ends so that they will not become sharp metal points. Other platings or coatings can be utilized in the process of this invention. Any sharp edges on the chrome-plating or other metallic-plating can be removed on a buffing wheel. The resulting structure is a hard metallic copy of the original fragile paper structure.

It should be noted that before the carbonization process, extra resin can be added to corners or edges of the structure to reduce sharpness or increase strength at a particular point on the structure.

The structure thus formed by the process of this invention can have a great many uses in industry. It should further be noted that this process need not be applicable only to small paper structures, but can be utilized in conjunction with substantially larger structures on which spray plating can be applied.

DESCRIPTION OF THE PREFERRED EMBODIMENT(S)

Figure 1:
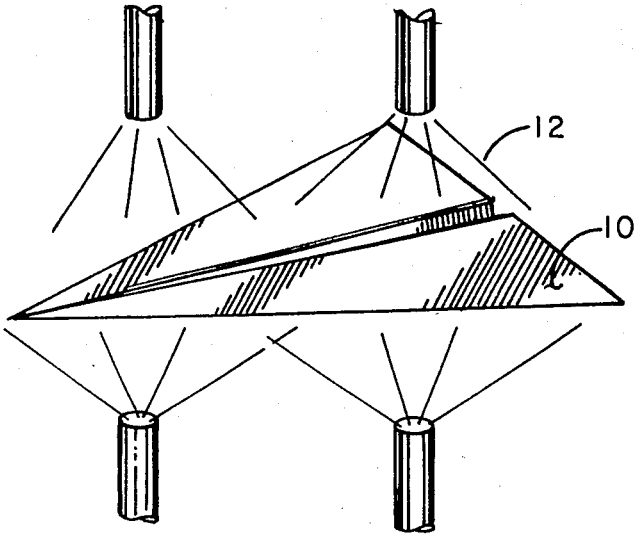
FIG. 1 illustrates a paper structure being sprayed with a carbonizable resin in a solvent.

FIG. 1 illustrates paper structure 10 being sprayed thoroughly with a carbonizable resin dissolved in a solvent 12. One suitable resin can be a resole phenol-aldehyde in an acetone solvent, but other equivalent resins and solvents could be utilized including less volatile solvents. Such spray must thoroughly saturate paper structure 10. It should be noted as mentioned above that any paper-like structure made of paper, paper-like material or equivalent material can be utilized in the process of this invention. The process of this invention is not limited to the production of paper airplane models but paper airplanes do form an ideal example of the type of folded or formed paper structure that can be made into a solid metallic product by the process of this invention.

Figure 2:
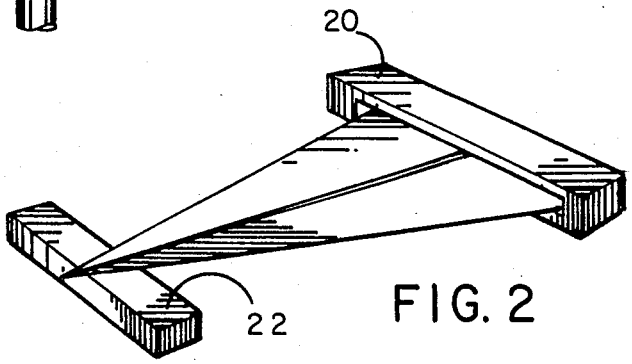
FIG. 2 illustrates the resin-permeated paper structure held by a jig while the solvent is evaporating and the resin is curing.
Figure 3:
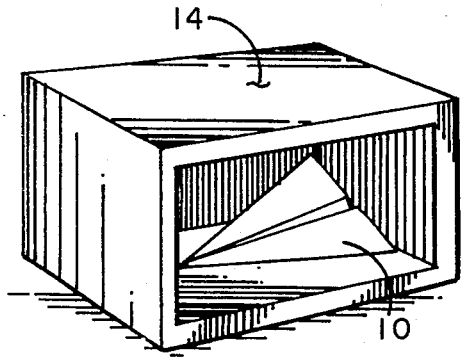
FIG. 3 illustrates the resin-treated structure being baked in an oven to carbonize the resin.
Figure 4:
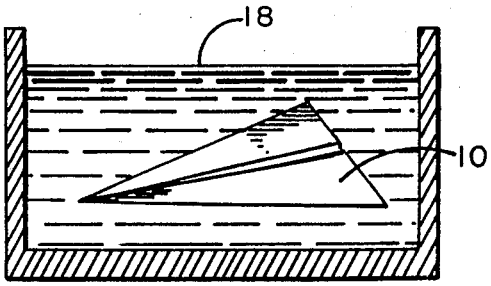
FIG. 4 illustrates the carbon structure in a plating bath having a metallic plating applied thereto.

In FIG. 2 the saturated paper is held in its original position by a jig(s) 20, the number of such jigs required differing for each structure depending upon the size and shape of the paper structure. As the solvent is driven off in the curing process, such jigs help to prevent deformation of the structure. After curing, the structure can be handled because it is a solid resin-permeated paper. Although the resin is hard after curing, the structure is still not extremely strong. One then places the structure in oven 14 in which it is baked to a temperature to carbonize the resin so that what remains is an exact copy of the original paper structure now composed of carbonized resin and the char of the original paper. Oven 14 should be of the type to allow the carbonization process to be accomplished in an inert atmosphere. This carbon structure is then placed in plating bath 18 as seen in FIG. 4. The plating can be any metallic plating which is strong enough and suitable to adhere to the carbon structure. The carbon, although somewhat strong, can be brittle and the plating forms a sandwich around the carbon to add structural strength to resist any lateral deformation of the final product.

It should be noted that to avoid very sharp edges on the finished product, any sharp edges on the original paper structure should be rounded or clipped at an angle before utilizing the process of this invention.

Figure 5:
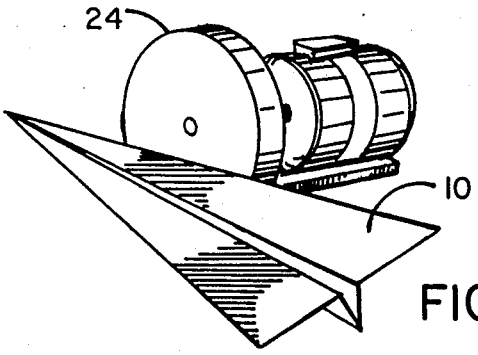
FIG. 5 illustrates the metallic structure having sharp edges removed by a buffing wheel.

Also, after the product has been completely plated an the metallic structure removed from the plating bath, any sharp edges can be removed on buffing wheel 24 as seen in FIG. 5.

The resulting product of the process of this invention is a solid metallic lightweight copy of the original paper structure which has been created without the use of expensive molds or other prior art methods of producing a metal product. It is envisioned that the economical method of production utilizing the process of this invention will have significant advantages in the production of a variety of industrial products such as complex forms which can be cheaply made of paper and then converted to metal but which might be very expensive to make of metal by methods of the prior art.

Although the present invention has been described with reference to particular embodiments, it will be apparent to those skilled in the art that variations and modifications can be substituted therefor without departing from the principles and spirit of the invention.

I claim:

1. A process for forming metallic structures out of shapes made of paper comprising the steps of:

forming said paper into a desired shape;

coating said paper with a carbonizable resin;

saturating said paper with said resin;

curing said resin;

baking said cured resin-saturated structure in an inert atmosphere;

carbonizing said resin by said baking step; and plating said carbon structure with a metallic plating.

2. The process of claim 1 further including holding said paper shape in its original formed shape while curing is taking place to prevent deformation of the paper shape.

3. The process of claim 1 further including the step of: removing any sharp edges from said carbonized structure by buffing processes.

4. The process of claim 1 further including the step of removing any sharp edges from said structure before plating.

* * * * *